US005611215A

United States Patent [19]

Saito et al.

[11] Patent Number: 5,611,215

[45] Date of Patent: Mar. 18, 1997

[54] RECEIVER DRIER

[75] Inventors: Kiyoaki Saito, Yokohama; Takuji Furuta, Kawasaki; Moriyoshi Endo, Tokyo, all of Japan

[73] Assignee: Fujikoki Mfg. Co., Ltd., Tokyo, Japan

[21] Appl. No.: 414,591

[22] Filed: Mar. 31, 1995

[30] Foreign Application Priority Data

Jun. 1, 1994 [JP] Japan ..... 6-120163

[51] Int. Cl.[6] ..... F25B 39/04; F16L 21/00

[52] U.S. Cl. ..... 62/509; 165/157; 285/137.1

[58] Field of Search ..... 285/137.1; 62/509, 62/503, 474; 138/92; 165/157, DIG. 348, DIG. 349, 916

[56] References Cited

U.S. PATENT DOCUMENTS

| | | | |
|---|---|---|---|
| 4,730,465 | 3/1988 | Inoue | 62/503 |
| 4,756,166 | 7/1988 | Tomasov | 62/509 |
| 5,365,751 | 11/1994 | Mikesell et al. | 62/298 |

FOREIGN PATENT DOCUMENTS

| | | |
|---|---|---|
| 4-106468 | 9/1992 | Japan . |
| 5-296609 | 11/1993 | Japan . |
| 6-10764 | 2/1994 | Japan . |

*Primary Examiner*—William E. Wayner

*Attorney, Agent, or Firm*—Oblon, Spivak, McClelland, Maier & Neustadt, P.C.

[57] ABSTRACT

A receiver drier includes a case having one open end and a closed end, and a cover member fixed to the open end of the case by welding to close the open end. A liquid refrigerant suction pipe is arranged in an inner space of the case and extends from a position which is located near to the open end of the case toward an inner portion of the case. A liquid refrigerant inlet hole for introducing a refrigerant into the inner space of the case, a liquid refrigerant outlet hole for leading the refrigerant from the suction pipe to an out of the case, and a connecting passage for connecting the refrigerant outlet hole with one end of the suction pipe which is located near to the opening end of the case are provided in the cover member. The cover member is thinned with at least a portion thereof corresponding to the connecting passage being remaining.

10 Claims, 5 Drawing Sheets

RECEIVER DRIER

BACKGROUND OF THE INVENTION

1. Field of the Invention

This invention relates to a receiver drier which is used in a compact air-conditioning system, for example used in a vehicle, to temporarily store a liquid refrigerant.

2. Description of the Related Art

FIG. 1 is a plan view, showing a conventional receiver drier of the above described kind, and FIG. 2 is a front view of the receiver drier of FIG. 1, in FIG. 2 an upper end of the receiver drier being cut away along line II—II of FIG. 1.

As is shown in FIG. 2, the conventional receiver drier has a substantially cylindrical case 10 having an upper opening end and a closed lower end, and a cover member 14 fixed to the upper opening end of the case 10 by means of such as an arc welding and closing the upper opening end. In FIG. 2, reference numeral 12 denotes a welding portion between the upper opening end of the case 10 and the cover member 14. In an interior space of the case 10, a filter (not shown) for removing impurities in a liquid refrigerant, and a liquid refrigerant suction pipe 16 are contained. The suction pipe 16 extends through the filter along a longitudinal center line of the case 10 from a position near to the cover member 14, that is near to the upper end of the case 10, toward an inner portion of the case 10 so that it reaches a position near to a lower end of the inner space. In an outer surface of the cover member 14 which faces an outer space of the case 10, a liquid refrigerant outlet hole 18 is formed at a position located radially outwardly from a center of the cover member 14.

On an inner surface of the cover member 14 which faces the inner space of the case 10, a projection 19 is formed to extend from an upper end portion of the the suction pipe 16 to a position corresponding to an inner end portion of the refrigerant outlet hole 18. In the projection 19, a connecting passage 20 is arranged so as to communicate the upper end portion of the suction pipe 16 with the refrigerant outlet hole 18. An outer end portion of the refrigerant outlet hole 18 which is located in the outer surface of the cover member 14 functions as a discharge pipe connecting portion 21 to which a distal end of a liquid refrigerant discharge pipe (not shown) is connected. A liquid refrigerant observation hole 22 is branched from the liquid refrigerant outlet hole 18, and extends to a center of the outer surface of the cover member 14. An outwardly extending end of the observation hole 22 is sealed by a liquid refrigerant observation window 24. Further, in the cover member 14, a liquid refrigerant inlet hole 26 is formed at a position which is symmetrical with the discharge pipe connecting portion 21 of the liquid refrigerant outlet hole 18 with respect to the observation window 24. The liquid refrigerant inlet hole 26 extends through the cover member 14 from the outer surface thereof to the inner surface thereof, and an outer end portion of the inlet hole 26 which is located in the outer surface of the cover member 14 functions as an inlet pipe connecting portion 28 to which a distal end of a liquid refrigerant supply pipe (not shown) is connected.

Blind screw holes 34 and 36 are formed in positions of the outer surface of the cover member 14 in the vicinity of the discharge pipe connecting portion 20 and the inlet pipe connecting portion 28, respectively. These screw holes 34, 36 are used for fixing pipe pressing members 30 and 32 attached to the distal ends of the liquid refrigerant discharge pipe and the liquid refrigerant supply pipe, on the outer surface of the member 14 by means of fixing screws (not shown). Thus, the distal ends of the liquid refrigerant discharge pipe and the liquid refrigerant supply pipe are respectively pressed against the outer surface of the cover member 14 to communicate with the discharge pipe connecting portion 20 and the inlet pipe connecting portion 28 formed in the outer surface of the cover member 14, and are fixed thereon by means of the pipe pressing members 30 and 32 and the fixing screws.

FIG. 3 is a front view showing another type of conventional receiver drier, an upper end portion thereof being cut away. The receiver drier of FIG. 3 has the same basic structure as that shown in FIGS. 1 and 2, and hence elements similar to those shown in FIGS. 1 and 2 are denoted by corresponding reference numerals and no detailed explanation thereof will be given. The receiver drier of FIG. 3 differs from the receiver drier of FIGS. 1 and 2 only in that the former does not have the liquid refrigerant observation hole 22 and the liquid refrigerant observation window 24, and a liquid refrigerant outlet hole 18' is formed in the center of the outer surface of the cover member 14 so as to be concentric with the liquid refrigerant suction pipe 16. A projection 19' is formed in the center of the inner surface of the cover member 14 so as to be projected to the upper end portion of the liquid refrigerant suction pipe 16. In the projection 19', a connecting passage 20' is formed so as to extend in concentric with the liquid refrigerant suction hole 16 and to connect the upper end portion of the liquid refrigerant suction pipe 16 with the inner end portion of the liquid refrigerant outlet hole 18'. Thus, the discharge pipe connecting portion 21' of the liquid refrigerant outlet hole 18' is located in the center of the outer surface of the cover member 14. FIG. 3 shows a longitudinal section of the blind screw hole 34 which is not shown in FIG. 2. The other blind screw hole 36 has the same longitudinal section as that of the hole 34.

FIGS. 4A and 4B show longitudinal sections of two examples in which a distal end of the liquid refrigerant discharge pipe 38 is fixedly connected to the discharge pipe connecting portion 21' of FIG. 3 by means of the pipe pressing member 30 and the fixing screw. These two examples are also applicable to a case where a distal end of a liquid refrigerant inlet pipe (not shown) is fixedly connected to the inlet pipe connecting portion 28 by means of the pipe pressing member 32 (FIG. 1) and the fixing screw. Further, it is a matter of course that those two examples are applicable to the conventional case of FIGS. 1 and 2 where the ends of the liquid refrigerant discharge pipe and the liquid refrigerant supply pipe (not shown) are fixedly connected to the discharge pipe connecting portion 20 and the inlet pipe connecting portion 28 in the outer surface of the cover member 14 by means of the pipe pressing members 30 and 32 and the fixing screws, respectively. In the example of FIG. 4A, a headed bolt 40 is used, while in the example of FIG. 4B, a combination of a stud bolt 42 and a nut 44 is used.

Since the cover member 14 of the first conventional receiver drier shown in FIGS. 1 and 2 and the cover member 14 of the second conventional receiver drier shown in FIGS. 3, 4A and 4B are obtained by cutting a round bar or a substantially disk-shaped blank which is formed by forging, the cover member 14 is thick and heavy. Further, it is difficult to appropriately and constantly satisfy a welding condition required to fix the thick, large and heavy cover member 14 which has a large thermal capacity, to the opening end of a thin peripheral wall of the case 10 in an airtight manner by welding. Therefore, a relatively great amount of time is necessary for welding.

SUMMARY OF THE INVENTION

This invention has been developed under the above-described circumstances, and its object is to provide a receiver drier having a light and easy-to-manufacture cover member which is easy to appropriately satisfy a welding condition required to be fixed to an opening end of a thin peripheral wall of a case which has a small thermal capacity, in an airtight manner by welding, thereby the cover member requiring a relatively small amount of time for welding.

In order to achieve the above described object, a receiver drier of this invention is characterized by comprising: a case having one opening end and the other closed end; a cover member fixed to the opening end of the case by welding to close the opening end; a liquid refrigerant suction pipe arranged in an inner space of the case and extending from a position which is located near to the opening end of the case toward an inner portion of the case; a liquid refrigerant inlet hole provided in the cover member to introduce a refrigerant into the inner space of the case; a liquid refrigerant outlet hole provided in the cover member to lead the refrigerant from the suction pipe to an out of the case; and a connecting pass, provided in the cover member, for connecting the refrigerant outlet hole with one end of the suction pipe which is located near to the opening end of the case, the cover member being thinned with at least a portion thereof corresponding to the connecting pass being remained.

Since the cover member which is thinned as described above reduces the weight and thermal capacity thereof, a welding condition which is required to fix the cover member to the opening end of the thin peripheral wall of the case in an airtight manner by welding, can be easily and appropriately satisfied at all times, and the welding requires a relatively small amount of time.

In order to achieve the above described object of this invention, another receiver drier of this invention comprises: a case having one opening end and the other closed end; a circular cover member fixed to the opening end of the case by welding to close the opening end, and having an inner surface facing to an inner space of the case and an outer surface facing to an outer space of the case; a guide projection, provided at a peripheral edge of the cover member, for guiding fitting of the cover member to the opening end of the case; a refrigerant suction pipe arranged in the inner space of the case and extending from a position which is near to the opening end of the case toward an inner portion of the case; a refrigerant inlet hole, passing through the cover member from the outer surface thereof to the inner surface thereof, for introducing a refrigerant into the inner space of the case; a refrigerant outlet hole, formed at a position in the outer surface of the cover member which separates from the refrigerant inlet hole, for leading the refrigerant to an out of the case; a radially extending projection provided on the inner surface of the cover member and extending in a radial direction of the cover member; and a connecting pass, provided in the radially extending projection, for connecting an inner end of the refrigerant outlet hole with an end of the refrigerant suction pipe which is located near to the opening end of the case, a portion of the inner surface of the cover member in which at least the radially extending projection is excepted, having an indent portion which is indented in comparison with a projected end of the guide projection.

In this receiver drier, the guide projection of the cover member makes a fitting of the cover member to the opening end of the case in a production line of the receiver drier ease. Further, since the portion of the inner surface of the cover member in which at least the radially extending projection is excepted, has the indent portion which is indented in comparison with the projecting end of the guide projection, weight and heat capacity of the cover member can be reduced, hence the welding condition, which is required to fix the cover member to the opening end of the thin peripheral wall of the case in the airtight manner by welding, can be easily and appropriately satisfied and the welding requires a relatively small amount of time.

Since the guide projection is provided at the peripheral edge of the cover member, the refrigerant inlet hole and the refrigerant outlet hole can be formed in the indent portion of the cover member which is surrounded by the guide projection, thereby forming of the refrigerant inlet hole and the refrigerant outlet hole being easy.

In order to achieve a further receiver drier of this invention comprises: a case having an opening; a cover member fixed to the case by welding so as to close the opening, and having an inner surface which faces an inner space of the case and an outer surface which faces an outer space of the case; a refrigerant suction pipe arranged in a substantially center portion of the inner space of the case, and extending from a position near to the cover member toward an inner portion of the case; a refrigerant inlet hole, passing through the cover member from the outer surface thereof to the inner surface thereof, for introducing a refrigerant from outside of the case into the inner space of the case; a refrigerant outlet hole, provided at a position of the cover member which separates from the refrigerant inlet hole and passing through the cover member from the outer surface thereof to the inner surface thereof, for leading the refrigerant from the inner space of the case to outside of the case; and a projection formed on the inner surface of the cover member and constructing a connecting pass for connecting the refrigerant outlet hole with an end of the refrigerant suction pipe which is located near to the opening of the case, a portion of the inner surface of the cover member in which at least the projection is excepted, being thinned.

Since the cover member thinned as described above reduces weight and heat capacity thereof, the welding condition which is required to fix the cover member to the opening end of a thin peripheral wall of the case in an airtight manner by welding, thereby the welding requiring a small amount of time.

Since the cover member is thinned and the refrigerant inlet hole and the refrigerant outlet hole are provided in the cover member to pass through the cover member from the outer surface thereof to the inner surface thereof, formation of these holes can be achieved by a plastic deformation process such as a press work which has a high productivity. Further, by forming the connecting pass concentrically with the refrigerant outlet hole, the cover entire member can be formed by the plastic deformation process such as a press work which has a high productivity.

In the receiver drier according to the invention, a filter may be provided in the inner space of the case to remove impurities contained in the liquid refrigerant.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DESCRIPTION OF THE PREFERRED EMBODIMENTS

Receiver driers according to the embodiments of the invention will be explained in detail with reference to FIGS. 5–12 in the accompanying drawings.

Figure 5:
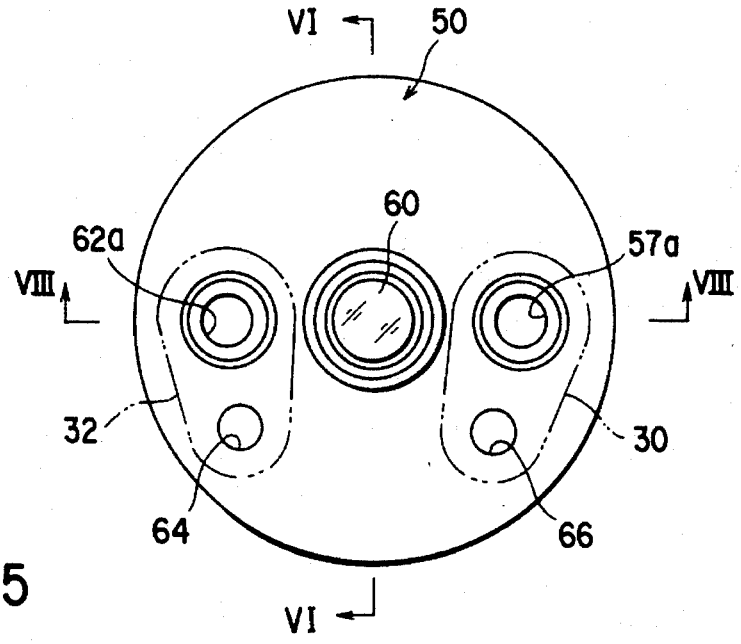
FIG. 5 is a plan view of a cover member which is used in a receiver drier according to an embodiment of the invention.
Figure 6:
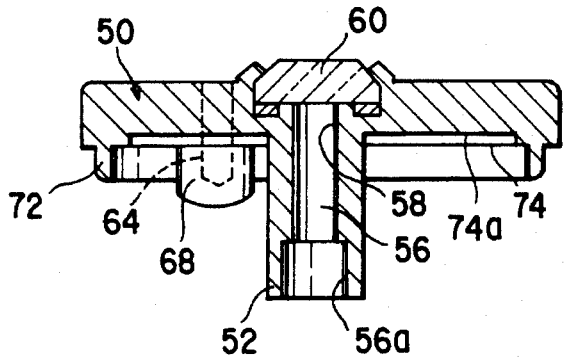
FIG. 6 is a vertical cross sectional view of the cover member taken along a line VI—VI of FIG. 5.
Figure 7:
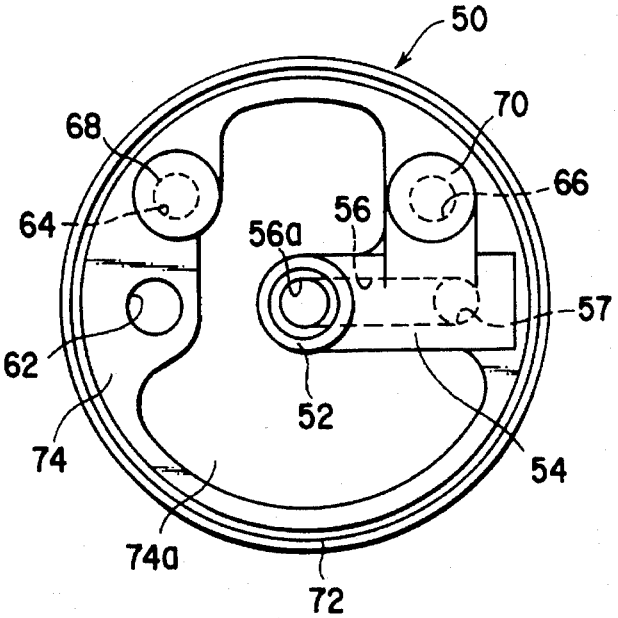
FIG. 7 is a lower view of the cover member of FIG. 5.

FIG. 5 shows a plan view of a cover member 50 which is used in a receiver drier according to one embodiment of the invention. FIG. 6 shows a longitudinal sectional view of the cover member 50 along a line VI—VI of FIG. 5. FIG. 7 is a lower view of the cover member 50 of FIG. 5.

As is shown in FIGS. 5–7, the cover member 50 has a circular flat shape and its upper surface (i.e. outer surface) is substantially flat. A longitudinal center projection 52 is formed on a center portion of a lower surface (i.e. inner surface) of the cover member 50 to project downward, and further a radially extending projection 54 is formed on the lower surface to extend radially outwardly from a proximal end portion of the center projection 52.

Figure 1:
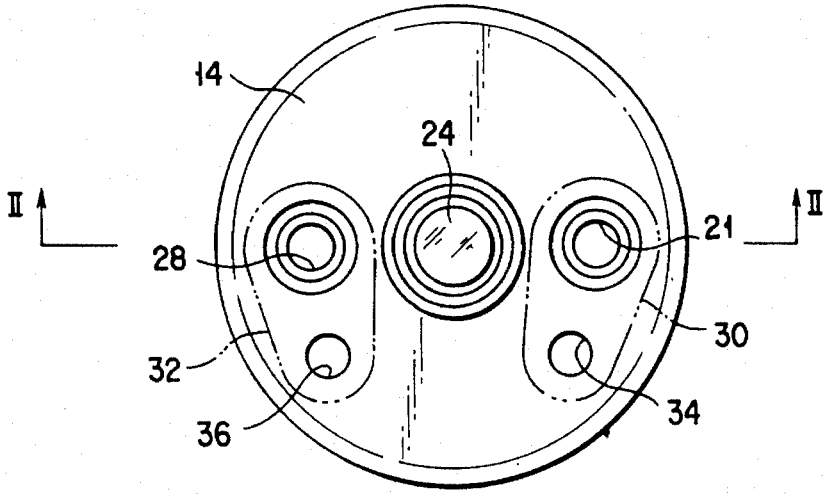
FIG. 1 (PRIOR ART)
FIG. 1 is a plan view of a conventional receiver drier.
Figure 2:
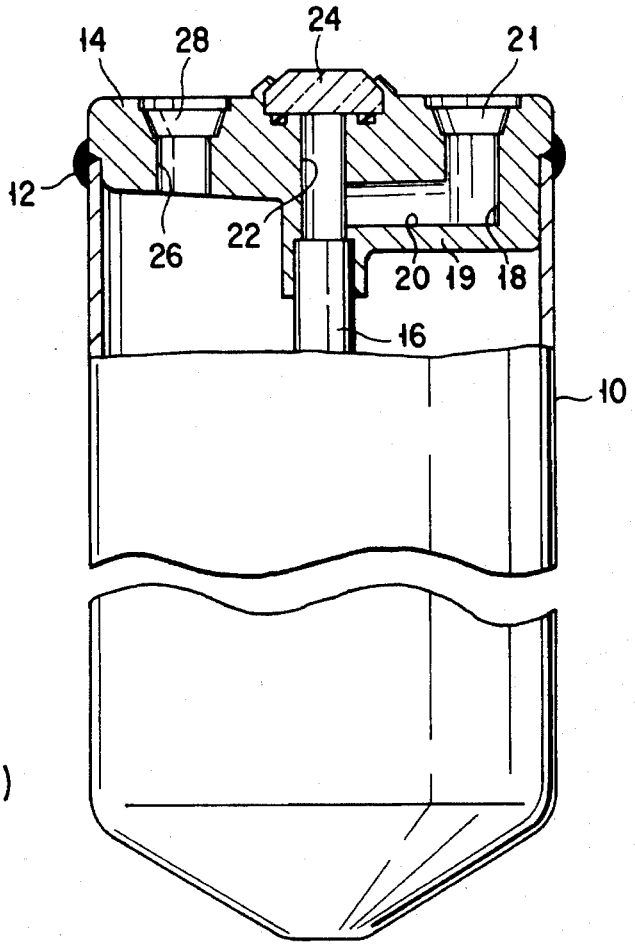
FIG. 2 (PRIOR ART)
FIG. 2 is a front view of the receiver drier of FIG. 1, in which an upper end portion of the receiver drier is cut out along a line II—II of FIG. 1.
Figure 3:
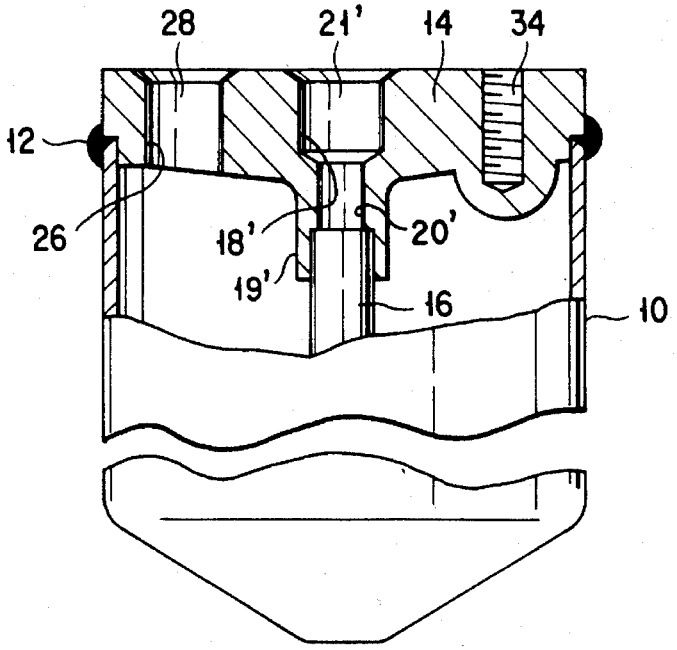
FIG. 3 (PRIOR ART)
FIG. 3 is a front view of another conventional receiver drier, in which an upper end portion of the receiver drier is cut out.
Figure 4A:
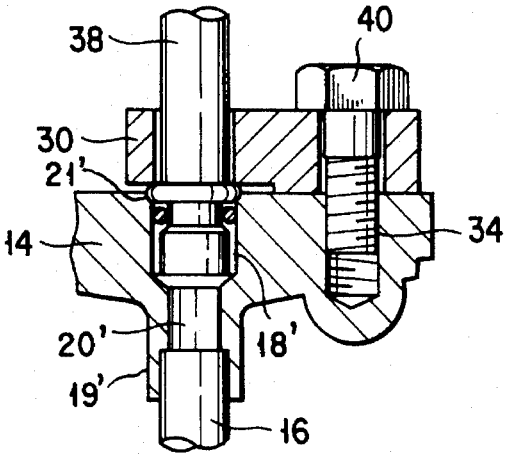
FIG. 4A (PRIOR ART)
FIG. 4A is a vertical cross sectional view showing an example in which a distal end of a liquid refrigerant discharge pipe is fixedly connected by means of a pipe pressing member and a headed bolt to a discharge pipe connecting portion formed in an outer surface of the cover member of the conventional receiver drier shown in FIGS. 1 and 2 or FIG. 3.
Figure 4B:
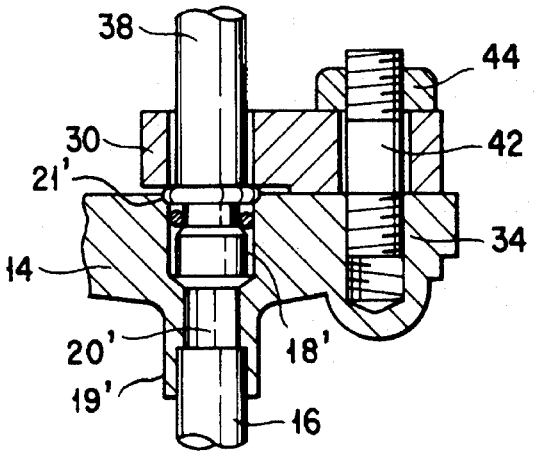
FIG. 4B (PRIOR ART)
FIG. 4B is a vertical cross sectional view showing another example in which the distal end of the liquid refrigerant discharge pipe is fixedly connected by means of the pipe pressing member and a stud bolt to the discharge pipe connecting portion formed in the outer surface of the cover member of the conventional receiver drier shown in FIGS. 1 and 2 or FIG. 3.

A connecting passage 56 is formed in the longitudinal center projection 52 and the radially extending projection 54 such that it extends upward from a lower end of the center projection 52, and then radially extends outward. A lower end portion of the connecting passage 56 located in the lower end of the longitudinal center projection 52 is constructed as a refrigerant suction pipe connecting portion **56*a* for connecting with an upper end of a refrigerant suction pipe to be described below. A refrigerant outlet hole 57 is formed at a position in the upper surface of the cover member 50 which corresponds to an outwardly extending end of the radially extending projection 54. An outer end of the liquid refrigerant outlet hole 57 in the upper surface of the cover member 50 functions as a refrigerant discharge pipe connecting portion 56*b* to which the distal end of the liquid refrigerant discharge pipe 38 as shown in FIGS. 4A and 4B is connected. An inner end of the refrigerant outlet hole 57 in an inner portion of the cover member 50 is connected to the outwardly extending end of the connecting passage 56. In this embodiment, a liquid refrigerant observation hole 58 is branched from the connection passage 56 in the longitudinal center projection 52, and extends toward a center of the upper surface of the cover member 50. An extending end of the liquid refrigerant observation hole 58 in the upper surface of the cover member 50 is sealed with an observation window 60**.

A liquid refrigerant inlet hole 62 is formed at a position in the upper surface of the cover member 50 which is located symmetrically with the refrigerant discharge pipe connecting portion **57*a* of the outer end of the refrigerant outlet hole 57 with respect to the liquid refrigerant observation hole 58. The refrigerant inlet hole 62 passes through the cover member 50 from the outer surface thereof to the inner surface thereof. An outer end of the refrigerant inlet hole 62 in the upper surface of the cover member 50 functions as a refrigerant inlet pipe connecting portion 62*a* to which the distal end of the liquid refrigerant inlet pipe (not shown), as in the case of the liquid refrigerant discharge pipe 38 shown in FIGS. 4A and 4**B, is connected.

Two blind screw holes 64 and 66 are formed in the upper surface of the cover member 50 in the vicinity of the refrigerant discharge pipe connected portion **57*a* of the outer end of the refrigerant outlet hole 57 and the refrigerant inlet pipe connecting portion 62*a* of the outer end of the liquid refrigerant inlet hole 62, respectively. Screw hole forming projections 68 and 70 project from portions of the lower surface of the cover member 50 which correspond to the blind screw holes 64 and 66**, respectively.

An annular guide projection 72 is formed on a peripheral edge of the lower surface of the cover member 50 to extend along a whole of the peripheral edge and to project downward. A portion of the lower surface of the cover member 50 other than a portion corresponding to the connecting passage 56 (that is, the center projection 52 and the radially extending projection 54), the two screw hole forming projections 68 and 70 and the guide projection 72 constitutes an indented portion 74 which is indented in comparison with the projected end of the guide projection 72. That is, the indented portion 74 is thinner in comparison with the portion corresponding to the connecting passage 56 (that is, the center projection 52 and the radially extending projection 54), the two screw hole forming projections 68 and 70, and the guide projection 72. A large part 74*a* of the indent portion 74 which is not located in the vicinity of the guide projection 72 is further indented from a proximal end of the guide projection 72 in a direction toward the outer surface of the cover member 50.

An outer configuration of the cover member 50 can be formed easily, for example by molding and/or forging of a metal material. In the receiver drier according to the embodiment of the invention, the members are formed by a cutting process: an outer peripheral surface of the guide projection 72 to be fitted in an opening end of a case which will be combined with the cover member 50; the refrigerant inlet pipe connecting portion 62*a* of the refrigerant inlet hole 62 and the refrigerant discharge pipe connecting portion 57*a* of the refrigerant outlet hole 57 which are to be connected to the ends of the liquid refrigerant inlet pipe (not shown) and the liquid refrigerant discharge pipe 38 (FIGS. 4A and 4B), respectively; the refrigerant inlet hole 62; and the two blind crew holes 64 and 66. Further, in the case of forming the entirely of the refrigerant inlet hole 62 by a cutting process such as a drilling process, the thickness of the cover member 50 between the upper and lower surfaces thereof is thinner than in the cases of the two conventional examples (shown in FIGS. 1 through 4B). Therefore, the time required for the cutting process such as the drilling process can be shortened, and the cutting process is facilitated.

Figure 8:
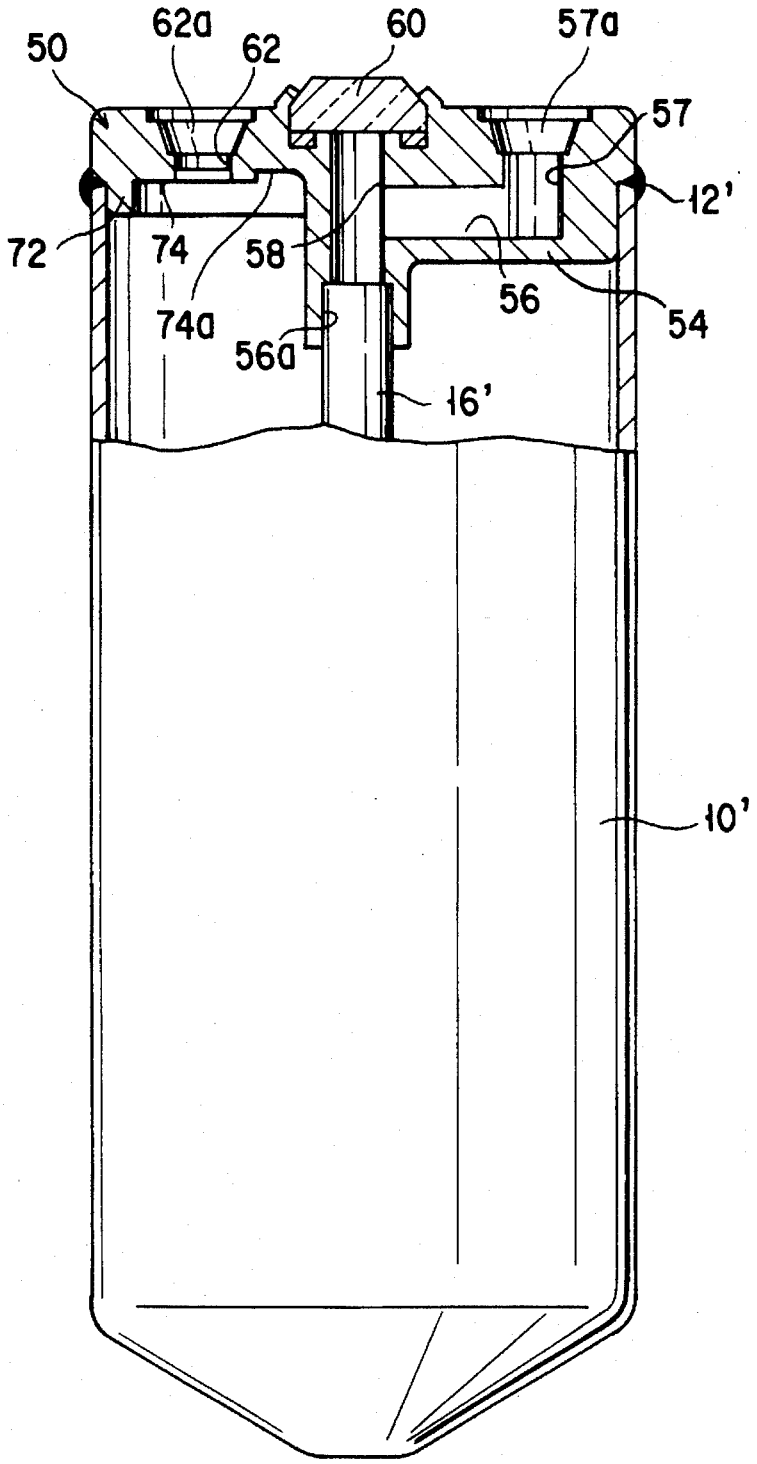
FIG. 8 is a front view of the receiver drier according to the embodiment of the invention, in which an upper end of the receiver drier is cut out along a line VIII—VIII of FIG. 5.

FIG. 8 shows a front view of the receiver drier according to the above embodiment of the invention. As is shown in FIG. 8, the outer peripheral surface of the guide projection 72 of the lower surface of the cover member 50 is fitted in and fixed in an airtight manner by means such as arc welding the opening end of a case 10' which is similar to the conventional case 10 of FIGS. 1–4B. And, reference numeral 12' denotes a welding portion between them. Like the case 10, the case 10' contains a filter (not shown) for removing impurities in a liquid refrigerant, and a liquid refrigerant suction pipe 16' which extends along a longitudinal center line of the case 10' from a position near to the closed lower end of the case 10' through the filter toward a position near to a center of the lower surface of the cover member 50. An upper end of the liquid refrigerant suction pipe 16' is fitted in the refrigerant suction pipe connecting portion 56*a* of the lower end of the connecting passage 56 located in the lower end of the center projection 52 on the lower surface of the cover member 50.

In this embodiment, the distal ends of the liquid refrigerant discharge pipe and the liquid refrigerant inlet pipe can easily be connected to the refrigerant discharge pipe connecting portion 56*a* and the refrigerant inlet pipe connecting portion 62*a* of the cover member 50 in a manner similar to the cases of the two examples shown in FIGS. 4A and 4B, i.e., by inserting the headed bolts 40 (FIG. 4A) through the pipe pressing member 30 and 32 and screwing them into the corresponding blind screw holes 64 and 66; or by screwing the nuts 44 (FIG. 4B) on the stud bolts 42 (FIG. 4B) planted in the blind screw holes 64 and 66 so that the pipe pressing members 30 and 32 are fastened on the upper surface of the cover member 50.

Figure 9:
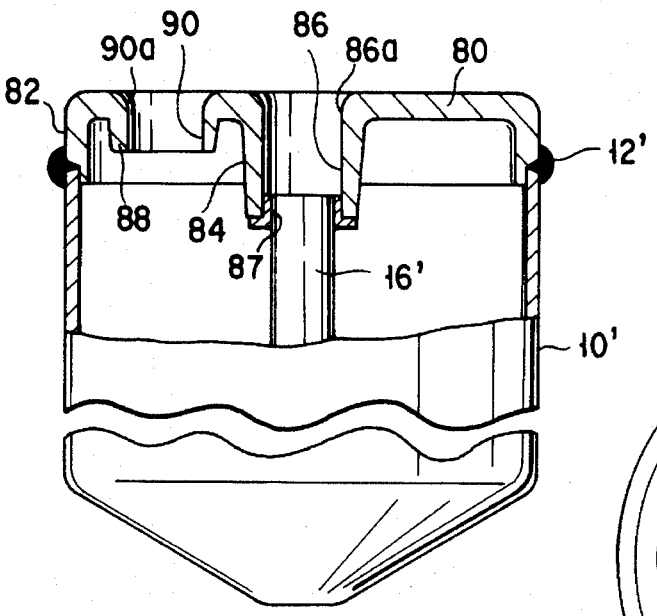
FIG. 9 is a front view of the receiver drier according to another embodiment of the invention, in which an upper end of the receiver drier is cut out.
Figure 10:
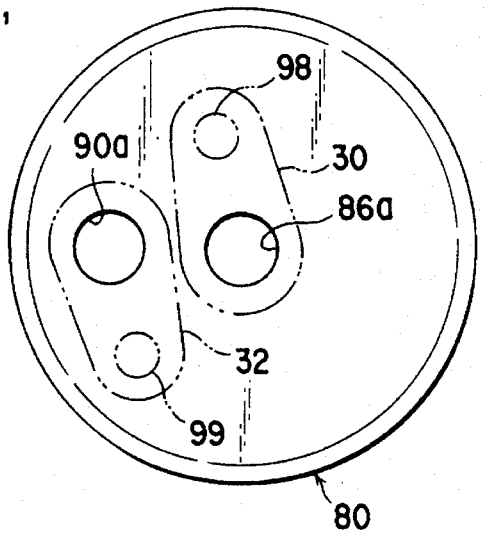
FIG. 10 is a plan view of a cover member used in the embodiment of FIG. 9.

FIG. 9 shows a front view of a receiver drier according to a second embodiment of the invention with an upper end portion of the receiver drier being cut out. FIG. 10 shows a plan view of a cover member 80 to be used in the receiver drier of the FIG. 9.

The cover member 80 of the receiver drier of this embodiment can be formed only by subjecting a metal to a plastic deformation process such as a press work. The entire peripheral edge of a lower surface of the cover member 80 is bent downward to form an annular guide projection 82.

A center portion of the cover member 80 is deeply drawned to have a cylindrical hollow projection 84 extending downward in a longitudinal direction of the cover member 80, and a center hole of the projection 84 passes from a lower end of the projection 84 to an upper surface of the cover member 80, thereby forming a refrigerant outlet hole 86. An outer end portion of the outlet hole 86 in the upper surface of the cover member 80 functions as a refrigerant discharge pipe connecting portion 86*a* to which a distal end of a liquid refrigerant discharge pipe is connected, as will be explained later.

A refrigerant suction pipe connecting portion 87 for connecting to an upper end of a refrigerant suction pipe described later is provided in an inner end portion of the refrigerant outlet hole 86, and the refrigerant suction pipe connecting portion 87 further functions as a connecting pass for connecting the refrigerant outlet hole 86 and the upper end of the refrigerant suction pipe described later. That is, in this embodiment, the refrigerant outlet hole 86 and the refrigerant suction pipe connecting portion 87 functioning as the connecting passage are concentrically and linearly arranged to each other to be constructed as one common hole.

Further, the cover member 80 is drawn at its position which is eccentric with the center position thereof so as to have a cylindrical eccentric hollow projection 88 extending downward in the longitudinal direction, and a center hole of the projection 88 passes from a lower end of the projection 88 to the upper surface of the cover member 80, thereby forming a liquid refrigerant inlet hole 90. An outer end of the inlet hole 88 in the upper surface of the cover member 80 functions as a refrigerant inlet pipe connecting portion 90*a* to which a distal end of a liquid refrigerant inlet pipe is connected, as will be explained later.

In the cover member 80 constructed as described above, it is a matter of course that a portion of the lower surface of the cover member 80 other than the guide projection 82 and the center projection 84 in which the liquid refrigerant outlet hole 86 and the connecting pass 87 are formed, is indented from a projecting end of the guide projection 82.

The weight, and hence the thermal capacity, of the cover member 80 formed by subjecting a metal plate to e.g. the plastic deformation process such as press work is smaller than that of the cover member 50 according to the first-mentioned embodiment explained with reference to FIGS. 5–8, which is formed by the molding and/or forging of a metal material.

Figure 11:
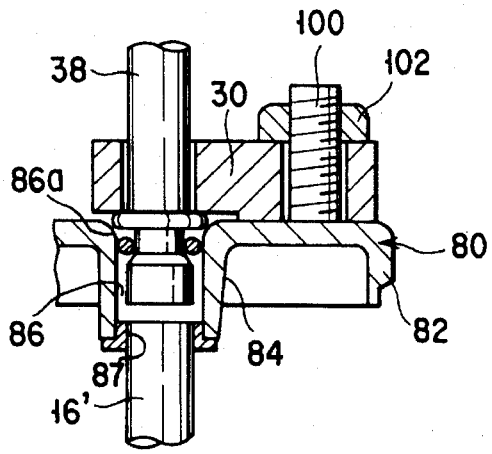
FIG. 11 is a vertical cross sectional view showing an example where the distal end of the liquid refrigerant discharge pipe is fixedly connected by means of the pipe pressing member and a fixed screw to a discharge pipe connecting portion formed in an outer surface of the cover member of the receiver according to the embodiment of the invention FIG. 9.
Figure 12:
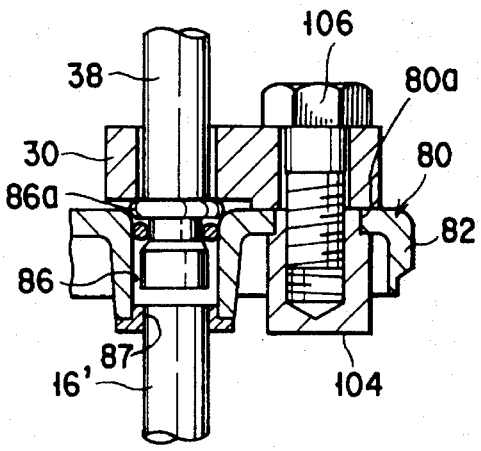
FIG. 12 is a vertical cross sectional view showing another example where the distal end of the liquid refrigerant discharge pipe is fixedly connected by means of the pipe pressing member and a headed bolt to a discharge pipe connecting portion formed in an outer surface of the cover member of the receiver according to the embodiment of the invention in FIG. 9.

FIG. 11 shows an example in which the distal end of the conventional liquid refrigerant discharge pipe 38 shown in FIGS. 4A and 4B is fixed, by means of the pipe pressing member 30 and a male screw member 100, in the discharge pipe connecting portion 86*a* in the outer surface of the cover member 80 according to the embodiment shown in FIGS. 9 and 10. FIG. 12 shows another example in which the distal end of the conventional liquid refrigerant discharge pipe 38 is fixed, by means of the pipe pressing member 30 and a headed bolt 106, in the discharge pipe connecting portion 86*a* in the outer surface of the cover member 80 according to the embodiment of FIGS. 9 and 10.

In the case of FIG. 11, the male screw member 100 such as a non-headed bolt is fixed, by means of fixing means such as welding, to a position 98 (FIG. 10) on the upper surface of the cover member 80 which is located near to the discharge pipe connecting portion 86*a*. A through hole formed in the pipe pressing member 30 to which the distal end of the liquid refrigerant discharge pipe 38 is fitted on the male screw member 100, and then a nut 102 is screwed on an upper end portion of the male screw member 100 which is projected upwardly from the through hole. As a result, the pipe pressing member 30 is fixed to the upper surface of the cover member 80, with the distal end of the liquid refrigerant discharge pipe 38 being fitted in the discharge pipe connecting portion 86a.

A distal end of a liquid refrigerant inlet pipe (not shown) can be fitted in the inlet pipe connecting portion 90*a* in the same manner as described above. Specifically, the male screw member 100 as shown in FIG. 11 is fixed, by means of fixing member such as welding, to a position 99 (FIG. 10) on the upper surface of the cover member 80 which is located near to the inlet pipe connecting portion 90*a*, and then a hole formed in the pipe pressing member 32 (FIG. 10) is fitted on the male screw member 100, the pipe pressing member 32 being fixed to the distal end of the liquid refrigerant inlet pipe (not shown), and then the nut 102 is screwed on an upper end portion of the male screw member 100 which is projected upward from the through hole.

In the case of FIG. 12, a through hole 80*a* is formed in a position 98 (FIG. 10) of the upper surface of the cover member 80 which is located near to the discharge pipe connecting portion 86*a*, and a cap screw member 104 is fixed in an airtight manner to a position of the lower surface of the cover member 80 which corresponds to the through hole 80*a*. A lower end portion of, for example, a headed bolt 106 inserted in the through hole formed in the pipe pressing member 30 which is fixed to the distal end of the liquid refrigerant discharge pipe 38 is screwed into a female screw hole of the cap screw member 104. As a result, the pipe pressing member 30 is fixed to the upper surface of the cover member 80 with the distal end of the liquid refrigerant discharge pipe 38 being fitted in the discharge connecting portion 86*a*.

A distal end of a liquid refrigerant inlet pipe (not shown) can be connected to the inlet pipe connecting portion 90*a* in the same manner as described above. Specifically, a through hole 80*a* as shown in FIG. 12 is formed at a position 99 (FIG. 10) in the upper surface of the cover member 80 which is located near to the inlet pipe connecting portion 90*a*, and a lower end, for example, of a headed bolt 106 inserted in the through hole formed in the pipe pressing member 32 to which the distal end of the liquid refrigerant discharge pipe (not shown) is fixed is screwed into the female screw hole of the cap screw member 104 fixed in an airtight manner to the lower surface of the cover member 80 at a position corresponding to the through hole 80*a*.

The through hole 80a can be formed in the portion 98 (FIG. 10) in the upper surface of the cover member 80 located near to the discharge pipe connecting portion 86*a* or in the portion 99 (FIG. 10) in the upper surface of the cover member 80 located near to the inlet pipe connecting portion 90*a*, at the same time as when cover member 80 is formed by the plastic deformation process such as the press work. Moreover, the through hole 80*a* can be formed by the plastic deformation process such as the press work or by the cutting process with the use of a drill, in independent of forming of the cover member 80.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A receiver drier comprising:

a case having an open end and a closed end;

a liquid refrigerant suction pipe arranged in an inner space of the case, and having one end located near to the open end of the case and an opposite end located at an inner portion of the case; and a cover member fixed to the open end of the case to close the open end, and being provided with a liquid refrigerant inlet hole located at a position independent of the one end of the suction pipe and introducing a refrigerant into the inner space of the case, a liquid refrigerant outlet hole located at a position independent of the inlet hole and the one end of the suction pipe, and a connecting passage formed in a first portion of the cover member, said passage connecting the refrigerant outlet hole with the one end of the suction pipe and leading the refrigerant from the suction pipe to a location outside of the case, the cover member being thinned at a second portion thereof other than said first portion.

2. A receiver drier according to claim 1, wherein the cover member has an inner surface which faces the inner space of the case, and an outer surface which faces an outer space of the case, the refrigerant inlet hole and the refrigerant outlet hole are passed through the cover member from the outer surface thereof to the inner surface thereof, and the connecting passage is provided in an inner portion of the cover member.

3. A receiver drier according to claim 2, wherein the connecting passage is provided in the inner portion of the cover member at a region near to the inner surface thereof.

4. A receiver drier as claimed in claim 1, wherein said connecting passage is located within the case.

5. A receiver drier comprising:

a case having an opening;

a cover member fixed to the case by welding so as to close the opening, and having an inner surface which faces an inner space of the case and an outer surface which faces an outer surface of the case;

a refrigerant suction pipe arranged in a substantially center portion of the inner space of the case, and extending from a position near to the cover member toward an inner portion of the case;

a refrigerant inlet hole, passing through the cover member from the outer surface thereof to the inner surface thereof, for introducing a refrigerant from an out of the case into the inner space of the case;

a refrigerant outlet hole, provided at a position of the cover member which separates from the refrigerant inlet hole and passing through the cover member from the outer surface thereof to the inner surface thereof, for leading the refrigerant from the inner space of the case to an out of the case; and a projection formed on the inner surface of the cover member and constructing a connecting passage connecting the refrigerant outlet hole with an end of the refrigerant suction pipe which is located near to the opening of the case, a portion of the inner surface of the cover member in which at least the projection is excepted, being thinned.

6. A receiver drier as claimed in claim 5, wherein said connecting passage is located in said case.

7. A receiver drier comprising:

a case having an open end and a closed end;

a circular cover member fixed to the opening end of the case and closing the opening end, and having an inner surface facing an inner space of the case and an outer surface facing an outer space of the case;

a guide projection, provided at a peripheral edge of the cover member, and guiding fitting of the cover member to the open end of the case; and a refrigerant suction pipe arranged in the inner space of the case, and having one end located near to the open end of the case and the other end located at an inner portion of the case;

the cover member being provided with a refrigerant inlet hole, passing through the cover member from the outer surface thereof to the inner surface thereof at a position independent of the one end of the suction pipe, and introducing a refrigerant into the inner space of the case, a refrigerant outlet hole, formed at a position in the outer surface of the cover member which separates from the refrigerant inlet hole and the one end of the suction pipe, a radially extending projection provided on the inner surface of the cover member and extending in a radial direction of the cover member from a position corresponding to the one end of the suction pipe to a position corresponding to the outlet hole, and a connecting passage, provided in the radially extending projection, connecting an inner end of the refrigerant outlet hole with the one end of the refrigerant suction pipe and leading the refrigerant from the suction pipe to a location outside the case, the inner surface of the cover member, excluding the radially extending projection, being indented as compared with a projected end of the projection.

8. A receiver drier as claimed in claim 7, wherein said connecting passage is located in said case.

9. A receiver drier comprising:

a case having an open end and a closed end;

a liquid refrigerant suction pipe arranged in an inner space of the case, and having one end located near to the opening end of the case and an opposite end located at an inner portion of the case; and a cover member fixed to the opening end of the case and closing the opening end, and being provided with a liquid refrigerant inlet hole located at a position independent of the one end of the suction pipe and introducing a refrigerant into the inner space of the case, a liquid refrigerant outlet hole located at a position independent of the inlet hole and the one end of the suction pipe, and a connecting passage connecting the refrigerant outlet hole with the one end of the suction pipe and leading to an outside portion of the case, the cover member comprising two portions, one of the two portions corresponding to the connecting passage and the other portion being thinner in comparison with the one portion.

10. A receiver drier as claimed in claim 9, wherein said connecting passage is located in said case.

* * * * *